US008127689B2

(12) United States Patent
Christian et al.

(10) Patent No.: US 8,127,689 B2
(45) Date of Patent: Mar. 6, 2012

(54) PLAY-BLE MULTIFUNCTIONAL RECREATIONAL SYSTEM

(76) Inventors: Dallas Baxter Christian, Dublin, GA (US); Daniel Chu West, Douglasville, GA (US)

( * ) Notice: Subject to any disclaimer, the term of this patent is extended or adjusted under 35 U.S.C. 154(b) by 555 days.

(21) Appl. No.: 12/231,774

(22) Filed: Sep. 5, 2008

(65) Prior Publication Data

US 2010/0058958 A1 Mar. 11, 2010

(51) Int. Cl.
*A47B 85/00* (2006.01)

(52) U.S. Cl. ..... 108/11; 108/25; 108/64; 108/12; 273/402

(58) Field of Classification Search ..... 108/25, 108/11, 12, 14, 19, 26, 26.2, 50.11; 273/402, 273/317, 400, 401
See application file for complete search history.

(56) References Cited

U.S. PATENT DOCUMENTS 2,596,663 A * 5/1952 Duffy ..... 108/69
2,621,095 A * 12/1952 Haumerson ..... 108/19
2,977,169 A * 3/1961 Geller ..... 108/19
3,087,442 A * 4/1963 Berliner ..... 108/19
4,237,795 A * 12/1980 Parker ..... 108/12
4,726,591 A * 2/1988 Johnson ..... 273/339
5,056,796 A * 10/1991 Conville ..... 273/402
5,320,360 A * 6/1994 St. Pierre ..... 273/402
D375,530 S * 11/1996 Rudd ..... D21/303
5,819,671 A * 10/1998 Ocampo ..... 108/64
6,321,662 B1 * 11/2001 Fraise ..... 108/25
7,607,666 B1 * 10/2009 Studier ..... 273/400
2003/0131765 A1 * 7/2003 Kaniuk et al. ..... 108/25

* cited by examiner

*Primary Examiner* — Jose V Chen

(57) ABSTRACT

The system is composed of two separate assemblies, each including a surface cover cap which can be removed to create an aperture dimensioned to allow a projectile to pass entirely through it. The assemblies are capable of being separated and inclined at a 45° angle to be used to play the popular multi-player game, beanbag toss. Additionally, the underside of each assembly is equipped with collapsible legs, which allow each assembly to become an independent freestanding table. When configured as freestanding tables, the assemblies may be arranged together in one of three ways: connected perpendicularly to form an L-shaped table, placed side-by-side to form a square table, or connected end-to-end to create a long table that can also be used to play the popular recreational game referred to commonly as beer pong.

3 Claims, 10 Drawing Sheets

PLAY-BLE MULTIFUNCTIONAL RECREATIONAL SYSTEM

CROSS-REFERENCE TO RELATED APPLICATIONS

| Application Number | Filing Date | Relationship of Application |
|---|---|---|
| 20020079645 | June 2002 | Portable Bag Toss Game |
| 20050023762 | February 2005 | Corn Bag Toss Game |
| 20050127609 | June 2005 | Game Tossing Objects into Box |
| 20060125186 | June 2006 | Bag Toss Game Target Assemblies |
| 20080042360 | February 2008 | Hybrid Bag Toss and Card Game |
| 20040188942 | September 2004 | Non-Alcoholic Beer-Pong Game |
| 20050029747 | February 2005 | Drinking Game Cup Holder |
| 20060065665 | March 2006 | Portable Cooler and Table |
| 20070107460 | May 2007 | Cup Holder For Drinking Game |

STATEMENT REGARDING FEDERALLY SPONSORED RESEARCH OR DEVELOPMENT

Not applicable

REFERENCE TO A MICROFICHE APPENDIX

Not applicable

BACKGROUND OF THE INVENTION

The Play-ble Recreational System will be used for recreational or entertainment purposes, and more specifically, the invention will primarily be used to play the lawn games popularly known as cornhole and beer pong. Cornhole and beer pong games have been played in the United States for many years using a variety of different names. In most cornhole games, players take alternating turns, each attempting to toss four sealed beanbags one at a time, through a hole in a stationary game assembly that is resting on the ground. Typically, two game assemblies are used, spaced approximately twenty-seven feet away from the players, with each game's playing platform tilted at an approximate 45° angle towards each of the players with respect to the ground on which the target is resting.

Cornhole can be played using a variety of rules. According to the American Cornhole Association, players are awarded three points for every beanbag that is tossed directly into or knocked entirely through the hole in the playing platform of each assembly, and one point for beanbags that land and remain on the playing platform but do not pass entirely through the hole in the platform. No points are awarded for beanbags that do not pass through the hole in the assembly or remain on the playing platform. Games are usually played until one of the players or a team of two players accumulates twenty-one points, but the player(s)' can decide to play until they reach any number of points.

Beer pong is a game that requires the use of some sort of tabletop and generally twelve wide mouth cups. Six cups are filled with equal portions of liquid, typically beer, and are aligned in a horizontal pyramid on the farthest ends of the table. Players on one side of the table attempt to throw or bounce a ping-pong ball into one of their opponent(s)' cups in the array on the other side of the table. If the ping-pong ball lands in any of the cups, one of the opponent(s) on that side of the table must drink the liquid in that cup and remove the cup from play.

BRIEF SUMMARY OF THE INVENTION

The object of the Play-ble Recreational System is to provide a multifunctional and portable device, which can be used to play cornhole and beer pong or be used as entertaining/dining table.

The present invention is comprised of two separate assemblies. The top surface of each assembly includes at least one through-aperture, approximately six inches in diameter, which is large enough to allow a beanbag to pass entirely there through. Attached to the underside and at the rear of each assembly, closer to the through-aperture, is a small collapsible leg mechanism (hereinafter referred to as "gaming leg mechanism") approximately twelve inches in length is attached, and when extended, allows each assembly to be angled toward the players, so that the game of cornhole may be played.

In addition to the gaming leg mechanism, the underside of each assembly is also equipped with two longer collapsible leg mechanisms (hereinafter called "table leg mechanisms" if referred to collectively), one in the front and one in the rear of each assembly. These table leg mechanisms allow assemblies to be able to transform into freestanding independent tables. Furthermore, once the assemblies have been transformed into separate tables, they can be joined end-to-end to form an elongated table, approximately seven-feet long, which can be used to play beer pong or serve as a dinning/serving table with the through-apertures at opposite ends of the table. Alternatively and additionally, the tables can be connected perpendicularly to one another to from an L-shaped buffet/serving table. When the present invention is in any one of the table variations, individual tables, L-shaped table, long dinner/serving table, or beer pong table, the through-apertures on the surface of each assembly can be plugged with plastic cover caps, thus creating a hole-free and completely solid surface. There are also optional attachments, other than the plastic cover caps, that will ultimately be manufactured for the invention that can be placed within the through-apertures in the tables such as ice buckets, condiment trays, trashcans, etc.

Another object of the present invention is to make the device portable and easy to transport. To achieve this goal, the assemblies will be constructed so that all of the leg mechanisms table and gaming leg mechanisms can be folded and secured underneath the assembly. Once this is done, the leg mechanisms will be completely hidden within the assemblies. The end result is that each assembly is only about two inches in depth. After the assemblies have been folded into this compact state, the assemblies can be stacked on top of one another and placed within a carrying/travel bag. This will allow the entire Recreational System to be easily stored and transported.

DETAILED DESCRIPTION OF THE INVENTION

The present invention will now be described in detail, with reference to the drawings that supplement this application. It should be noted that the attached drawings represent only one of many possible embodiments of the invention and should not be limited to or understood to be the only possible embodiment of the invention.

The use and assembly of the present invention will be described using FIGS. 1-10B. The invention is intended to be a portable and multifunctional entertainment device that can serve as a dinner/entertaining table, cornhole game, and beer pong table. While the top and side surfaces of the invention may ultimately be composed of a wide variety of different materials, they will most likely be constructed out of a rigid material, such as plywood or heavy duty plastic, so that the device can be sturdy enough to support substantial weight when used as a table. Also, when the invention is used to play cornhole, these types of rigid materials help the top surface of the assembly absorb the impact of the beanbags without causing the bags to ricochet off the assembly. Finally, the durability of plywood and plastic allows the invention to be used equally well both indoors and outdoors and withstand harsh treatment.

Figure 1:
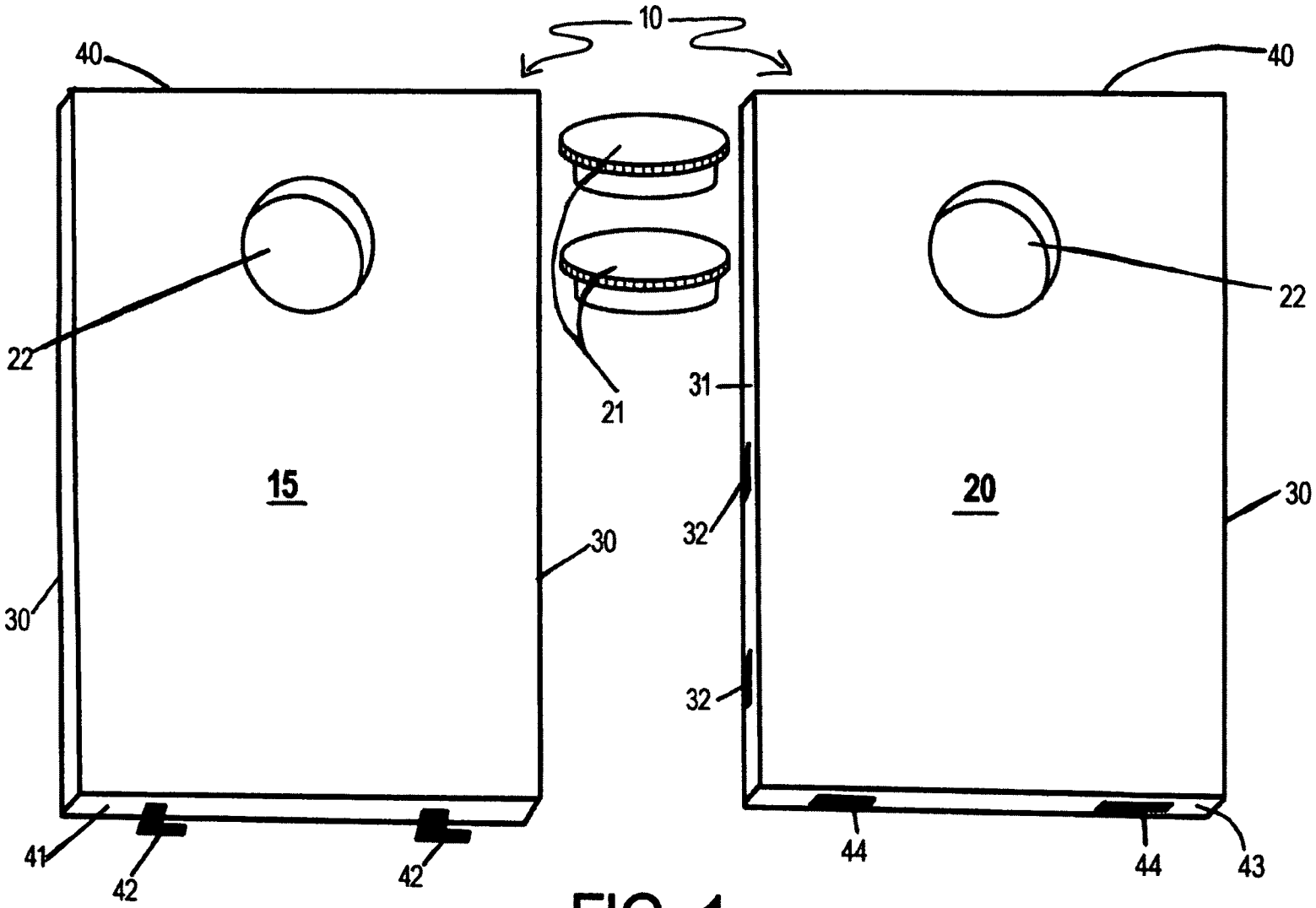
FIG. 1 is an aerial view of the surface of the two separate target assemblies and detachable caps, as they would appear if laid flat on the ground with all legs folded flat inside the assembly.

FIG. 1 is an aerial view of the invention referenced as 10. This illustration shows the top surfaces of the two individual assemblies referenced as 15 and 20. The dimensions and construction of assemblies 15 and 20 are identical in almost every way except for a few key differences, specifically the connecting mechanisms 42, 44 and 32, which will be discussed shortly. While the exact dimensions of the invention 10 are not essential to the construction or use of the invention 10, they are included in this writing so as to give the examiner a better understanding of size of the assemblies 15 and 20. The dimensions set forth here should not be understood or construed to be the only suitable dimensions of the invention; they are simply the inventors' best estimates of the optimal size of each assembly. This being said, the dimensions of each assembly 15 and 20 are approximately twenty-four inches wide 40, 41, and 43, by forty-four inches long 30 and 31. All of the aforementioned sidings of the assemblies 15 and 20 have an approximate depth of two inches. Both the left and right sides 30 of the male assembly 15 and the right side 30 of the female assembly 20 are constructed out of solid pieces of rigid siding, as are the rear sides 40 of both assemblies. The composition of the left side 31 of the female assembly 20 is primarily one solid piece of rigid siding, except for the two hollow cut outs 32 that will serve as connecting mechanisms (hereinafter referred to as female connector pieces). The function of these female connector pieces 32 is to allow a male assembly 15 to connect to the assembly 20 on which the female connector pieces 32 are attached, thus creating and L-shaped table. The specifics of the L-shaped table and connecting procedure will be analyzed in detail in FIGS. 7 and 9.

The front side 43 of the female assembly 20 looks and functions almost identically to the left side 31 of the assembly, with the length of the sides being the only difference between the two. Like the left side 31 of the female assembly 20, the front side 43 is fitted with two female connector pieces 44 which allow a male assembly 15 to connect end-to-end with the female assembly 20, thus forming a long table which can be used as a dinning/serving table or as a beer pong table. The specifics of the dinning table/beer pong table and connecting procedure will be analyzed in detail in the analysis of FIGS. 7 and 8.

The front side 41 of the male assembly 15 is also constructed out of a solid piece of rigid siding, but is also equipped with two protruding L-shaped male connector pieces 42 (hereinafter referred to as male connector pieces). The male connector pieces 42 will connect with female connector pieces 44 and 32 to form any of larger tables previously mentioned. The connecting procedure will be described in detail in FIG. 7.

Located on the top surface and proceeding completely through each of the assemblies 15 and 20 is a through aperture 22, with a diameter of approximately six inches, which is large enough to allow a beanbag to pass completely there through when the assemblies 15 and 20 are being used for game play. Two cover caps 21 will most likely be included with the purchase of the invention 10 that will fit flush within and completely cover the apertures 22 creating a completely solid and unitary top surface. In addition to these caps 21 there may also be a plethora of other optional and/or additional attachments that could be manufactured to fit within the apertures 22, such as ice buckets, condiment trays, trashcans, etc. when the assemblies 15 and 20 are being used as tables.

Figure 2:
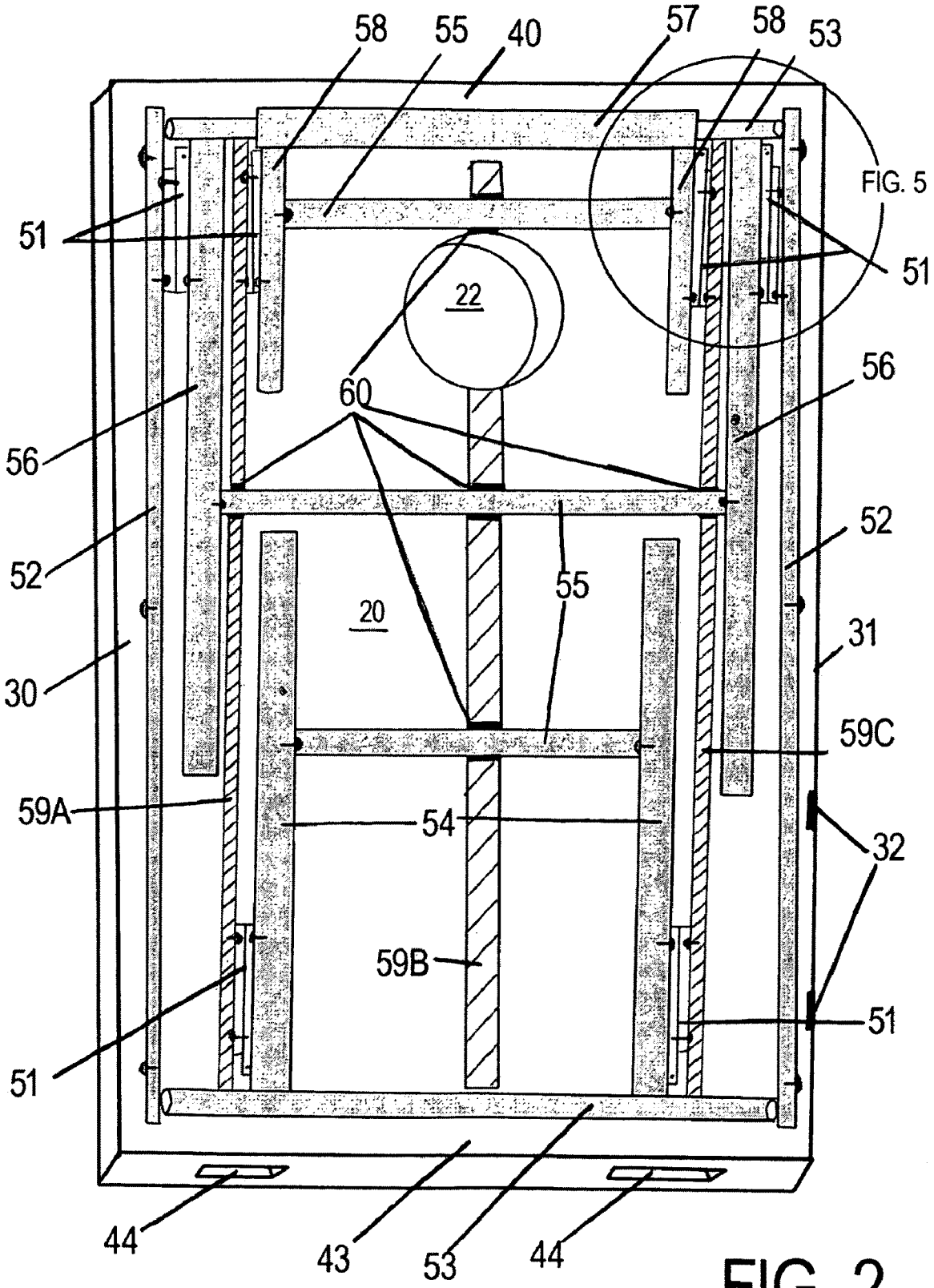
FIG. 2 is an aerial view of the underside of one of the target assemblies, as it would appear if laid flat with its surface against the ground and all legs folded flat inside the assembly.
Figure 3:
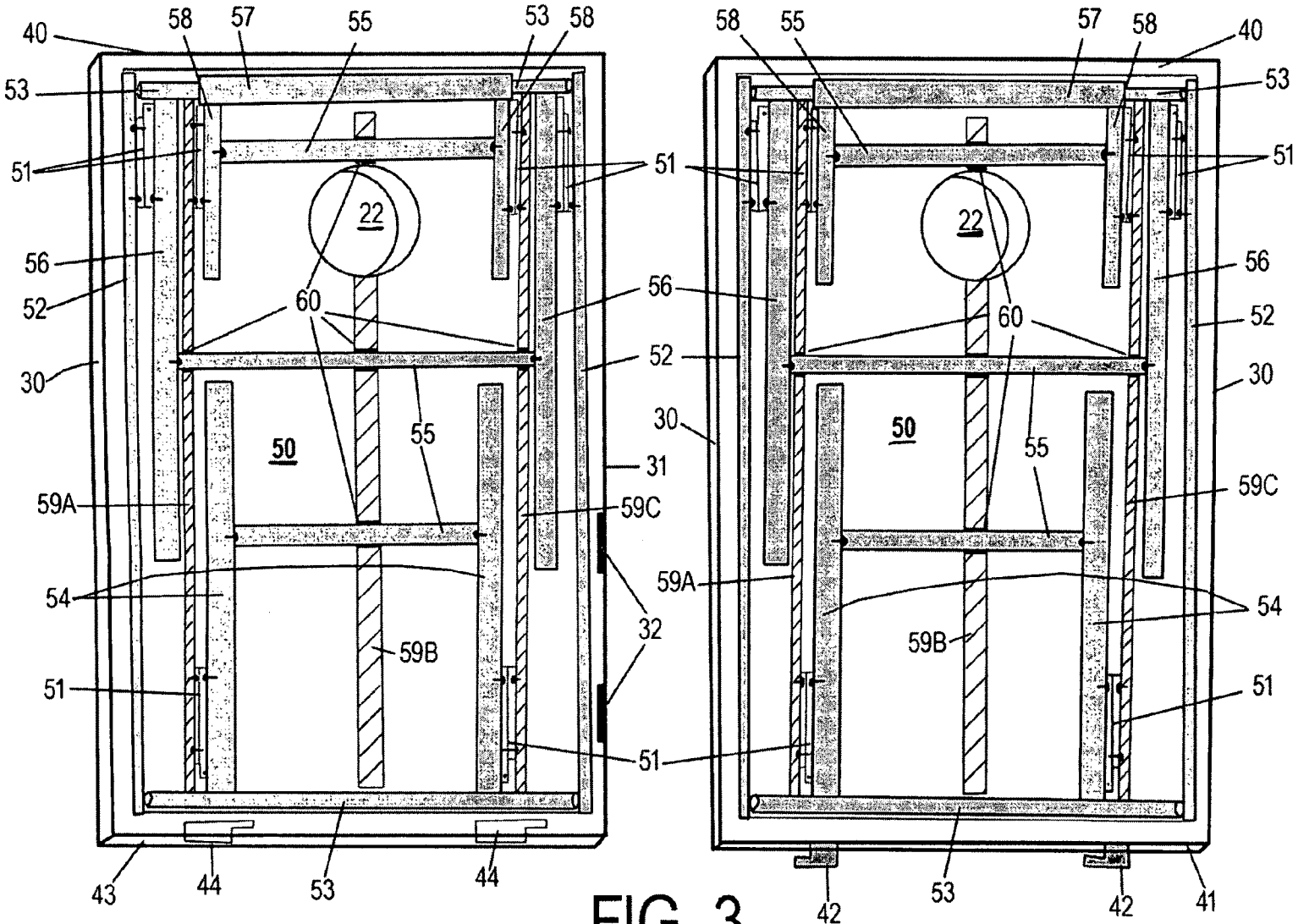
FIG. 3 is the same view aerial viewpoint depicted in FIG. 2, illustrating both assemblies side by side in their most compact and portable states.

FIG. 2 is an aerial view of the underside of the female assembly 20 with the through aperture 20 located towards the top of the assembly 20 and all of its legs 54, 56, and 58 folded completely flat (for an identical view depicting the male assembly 15, refer to FIG. 3). Both sides 30 and 31, along with the rear 40 and front 43 are raised approximately two inches from the bottom surface of the assembly 20 and create a storage space for all of the legs 54, 56, and 58 whenever any of those legs are not in use. As illustrated in FIG. 2, all of the invention's table and game legs can fold completely within the two inch raised border created by the four sides of each unit and cannot be seen when viewed from the side. As shown in FIG. 2, both connecting mechanisms 44 and 32 are located in midway down their respective sides 43 and 31, approximately one inch down. FIG. 2 depicts assembly 20 in its most compact and portable configuration and is how the invention will be configured when in travel mode.

Both assemblies 15 and 20 have been constructed to withstand harsh treatment and maintain its structural integrity without breaking down or falling apart when used as a table, beer pong table, or cornhole. FIG. 2 illustrates this fact by showing the two strong metal rails 52 that run along side and which are securely fastened to the two longer sides 30 and 31 of the assembly 20. These structural rails 52 also provide a stationary base for the table leg mechanism's 56 brackets 51 to anchor onto. Another important aspect of the structural rails 52 is that they serve as connecting point for the metal tubing 53 that allows all of the table leg mechanisms 54 and 56 to rotate on and extend down to create a table. Another tube with a slightly wider circumference 57 is fitted around the rear tube 53 that is closer to the through aperture 22. This wider tube 57 is attached to the gaming leg mechanism 58 and allows these legs to move independently and without disturbing the table leg mechanism 56. In other words, the wide tube 57 allows the table leg mechanism 56 to extend while the gaming leg mechanism 58 remains folded within the assembly 20 and allows the gaming leg mechanism 58 to extend, while the table leg mechanism 56 remains recessed within the assembly 20. While the two metal tubes 53 allow the leg mechanism 54, 56, and 58 to rotate and fold out of the assembly 20, the four brackets 51 dictate how far the legs will extend and lock them into the predetermined destination. In this case, the predetermined destination is perpendicular to the assembly's 20 surface or 90 degrees to create a table, or gaming assembly. The exact mechanics of these brackets will be described in further detail in FIG. 5.

Another important aspect of the assembly 20 are the three vertical columns 59A, 59B, and 59C that run the length of the assembly 20. These columns 59 serve three distinct functions and will most likely be composed of the same material as the surface and sides of the invention 10, but may ultimately be composed of any kind of rigid material, such as aluminum, steel, etc. First, they will reinforce and further stabilize the invention 10, making each assembly 15 and 20 more reliable when used as a table or as a cornhole game. Secondly, the two outer columns 59A and 59C, act as immobile supports for the brackets 51, which are also connected to leg mechanisms 54 and 58, to anchor themselves to. Finally and most importantly, the columns will provide a way to secure the leg mechanisms 54, 56, and 58 underneath the assemblies 15 and 20 when they are not in use. To accomplish this task, five cut out indentions 60 will be located on the three columns, that are just wide enough to allow the leg mechanisms' stability bars 55 to snap and stay in a folded position. As shown in FIG. 2, the two outer columns 59A and 59C will each only need one cut out indention 60 to secure the outer table leg mechanism 56 into place. The center column 59B however, will need to have three cut out indentions 60, one for each leg mechanism 54, 56, and 58.

FIG. 3 is taken from the exact same aerial view as FIG. 2 and is only included for two reasons. First, to show what both assemblies would look like side by side with their top surfaces facedown. And secondly, to show what both of the assemblies 15 and 20 would look like in travel mode with all leg mechanisms, table 54, 56 and game 58, folded completely flat within the recesses of their respective assemblies. In this compact state, the assemblies will be able to be stacked one atop the other and be transported and stored.

Figure 4A:
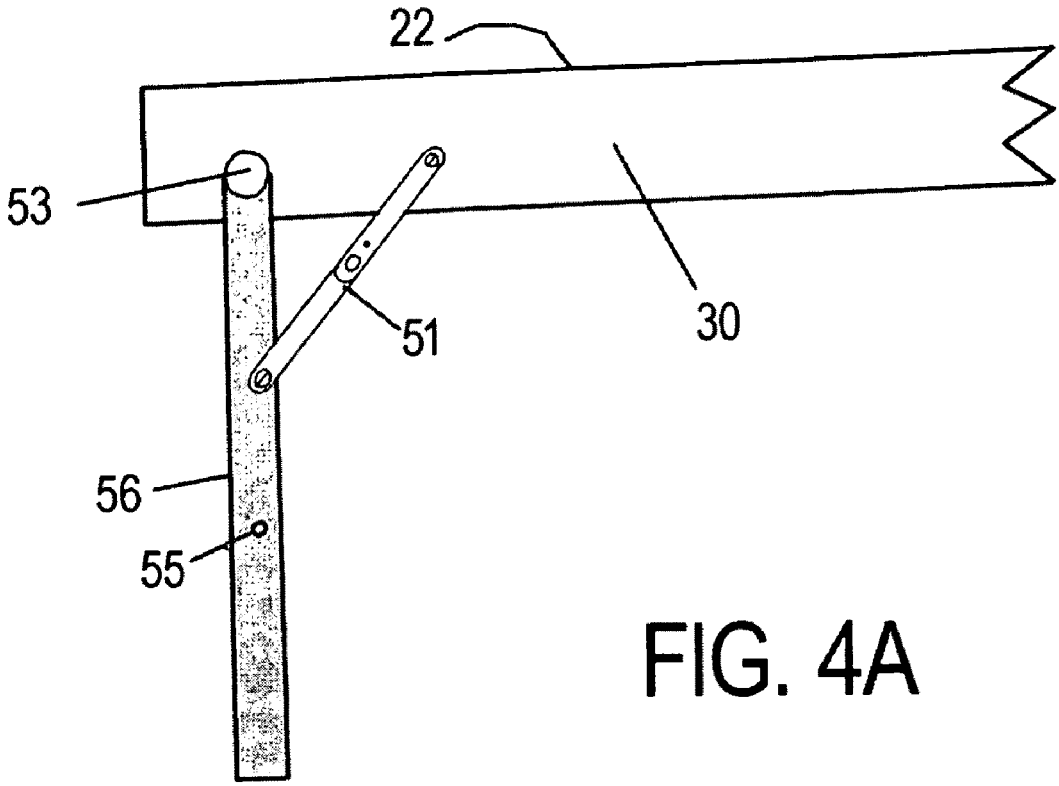
FIG. 4A is a section view showing a portion of the assembly shown in FIGS. 2 and 3, specifically showing one of the table legs being extended out from the side of the assembly.
Figure 4B:
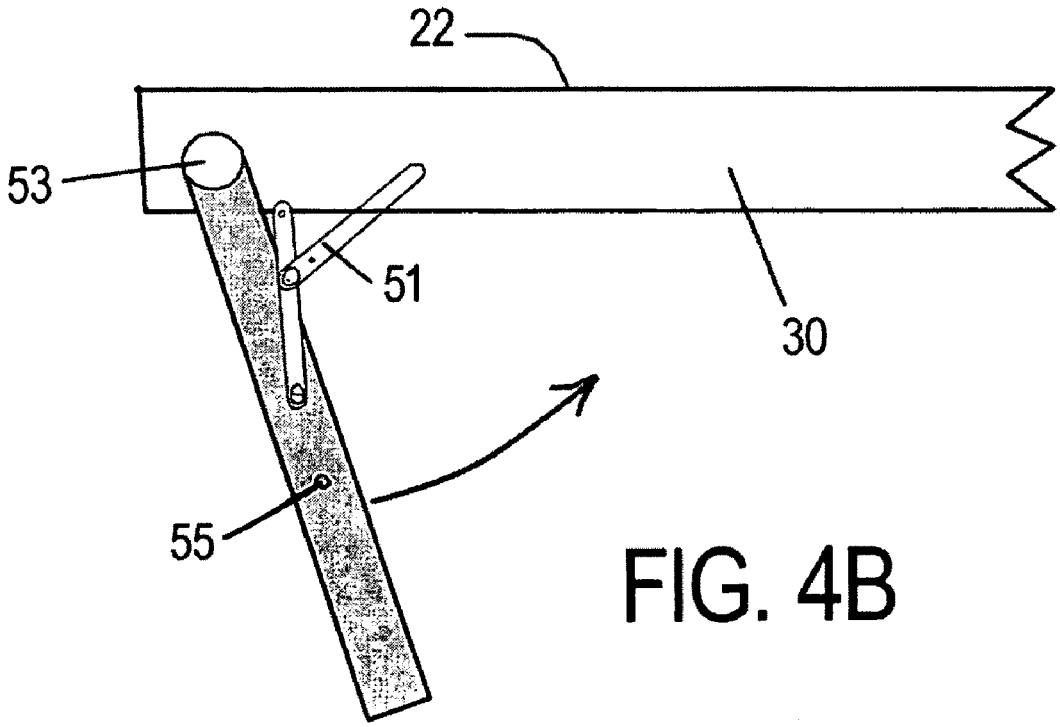
FIG. 4B is an alternate position of the table leg shown in FIG. 4A and specifically shows how the bracket will break and rotate to allow the table leg to fold into the assembly.

FIGS. 4A and 4B are sectional and perspective views of the intersection of the right 30 and rear 40 side of the male assembly 15 and depict the rear table leg mechanism 56 fully extended and locked into position by a bracket 51. FIG. 4A is a perspective depiction of what assembly 15 would look like if unfolded into a table. The metal tube 53 allows the rear table leg mechanism 56 to rotate down from a folded position within the table into the extended position depicted in FIG. 4A. The rear leg mechanism is a single unitary part and includes two legs which are connected together by a support bar 55, allowing both legs to move in unison. So even while FIGS. 4A and 4B may be illustrated to show only one of the two table legs, the second leg is hidden behind the leg closest to the viewer. As mentioned previously, the brackets 51 are secured to both the table leg and the right side 30 of the assembly 15. However, the middle of each bracket 51 is not connected to anything stationary, and is able to swivel freely about a hinge when not in its locked position, which is described more fully in FIG. 5.

FIG. 4B is an alternate view of FIG. 4A and shows the rear table leg mechanism 56 beginning to fold back into the recess created by the sides 40 and 30 of the assembly 15. As in FIG. 4A, the fixed metal tubing 53 allows the leg mechanism 56 to rotate upward into the assembly 15, as shown by the arrow. FIG. 4B shows bracket 51 broken out of its locking position and following/swiveling with the upward movement of the table leg mechanism 56. Part 55 is still connecting the two rear legs 56 forcing the legs to move as one. While only the rear table leg mechanism 56 is depicted in FIGS. 4A and 4B, it should be understood that the other two leg mechanisms 54 and 58 depicted in FIG. 2 and FIG. 3, utilize the same method of folding and extension as the rear leg mechanism 56 depicted in FIG. 4A and FIG. 4B.

Figure 5:
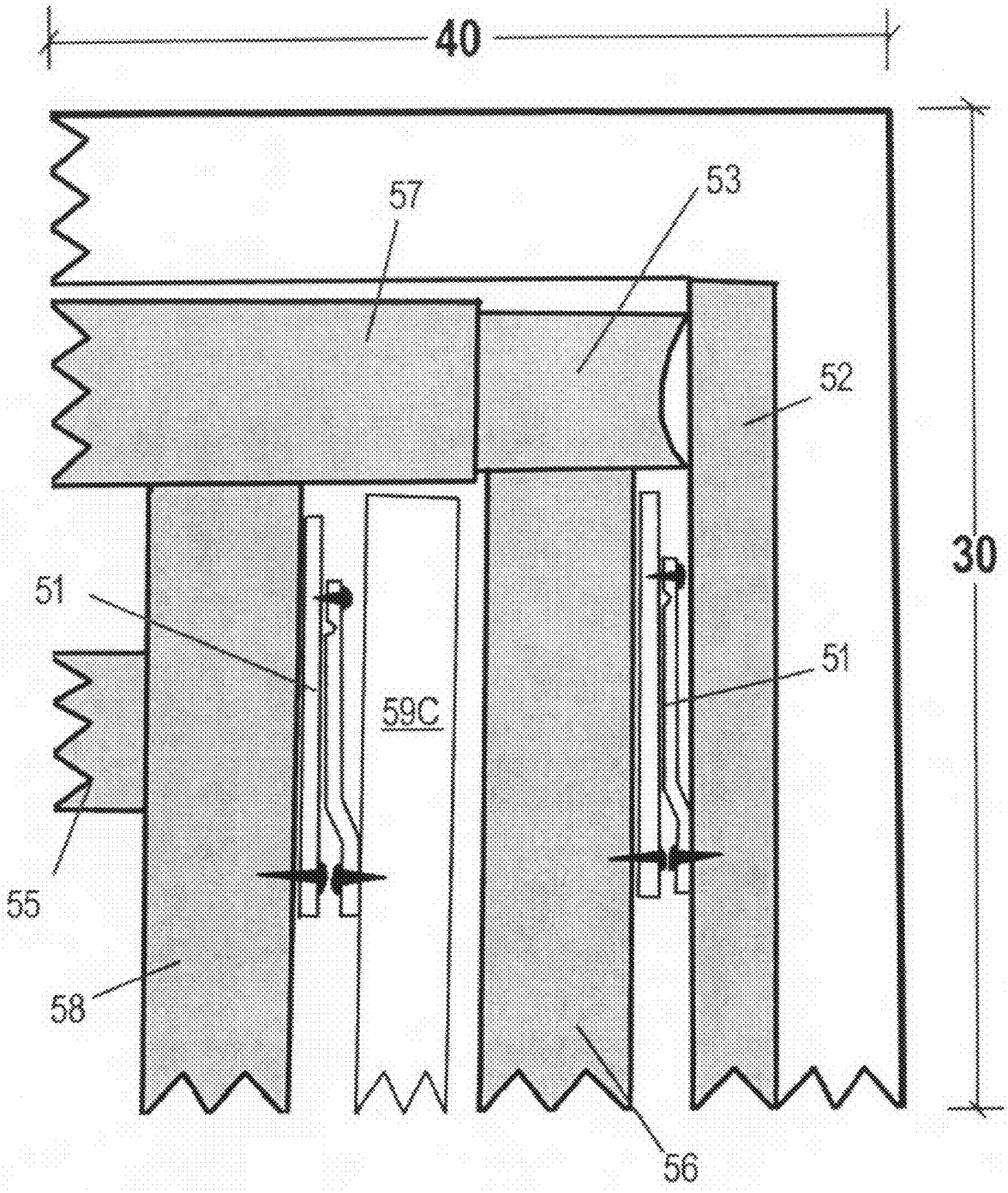
FIG. 5 is a section view showing the top right corner of the assembly shown in FIG. 2, specifically showing where the table legs and brackets will be situated and how they will be attached to the assembly and to each other.

FIG. 5 is a sectional and aerial view of the top right corner, as created by the intersection of the rear 40 and right 31 side, of the assembly 20 as circled in FIG. 2. As depicted in FIG. 2, the brackets 51 are folded completely in half on top of itself, with one end B4 securely fasted to its respective leg mechanism 56 or 58 and the other end B5 fastened to an immobile part 52 or 59A of the assembly 20. The middle of each bracket is able to rotate on a hinge B3, which allows the bracket 51 to extend with its respective leg mechanism 56 or 58 as the leg mechanism rotates on its respective metal tubing 53 or 57 and extends out of the assembly. The most important function of the brackets 51 is that they restrict the movement of the leg mechanisms 54, 56, and 58 and lock them into place at a 90° angle in relation to the assembly 20. To achieve this, each bracket 51 is fitted with two interlocking pieces B1 and B2 that lock into one another and don't allow the bracket 51 to extend or the leg mechanisms to rotate any further. The fully extended and locked bracket 51 is shown clearly in FIG. 4A. FIG. 4B shows the bracket 51 in its transition phase. There will be six brackets 51 on each assembly, two per leg mechanism 54, 56, and 58 as shown on FIGS. 2 and 3.

Figure 6B:
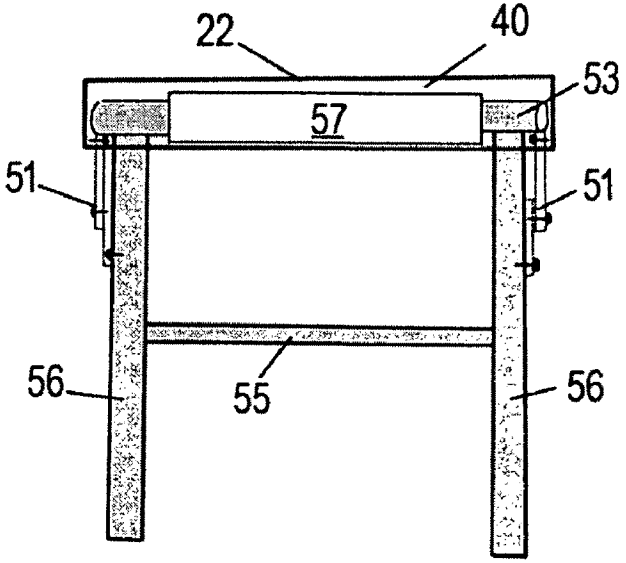
FIG. 6B is the same assembly shown in FIG. 6A, but taken as to show the rear of the table.
Figure 6A:
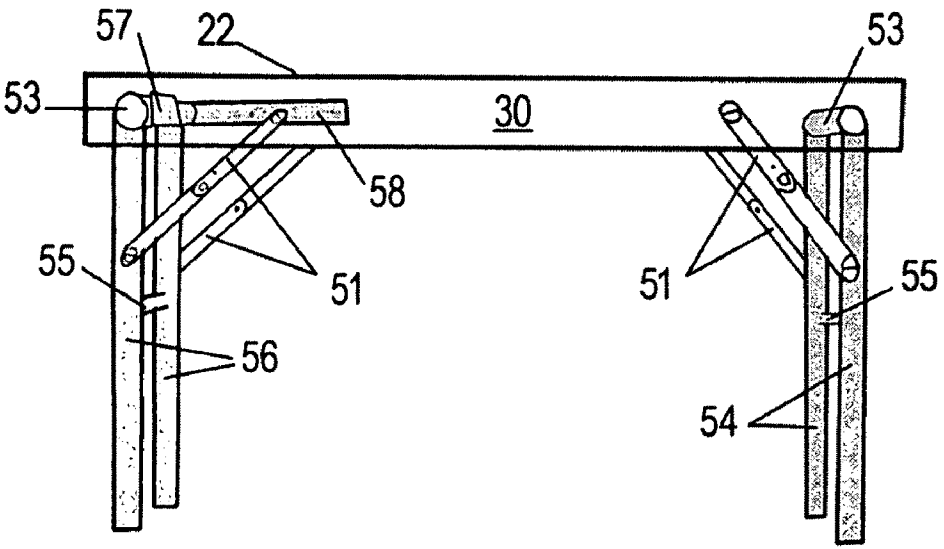
FIG. 6A is a perspective view of one of the assemblies, taken from a side view to show the assembly with its legs extended, thus creating a table.

FIGS. 6A and 6B are perspective views of one of the assemblies 15 or 20 standing as an independent table. As shown, both table leg mechanisms 54 and 56, connected together by their support bars 55, have rotated down on their respective metal tubing 53 and are completely extended and locked into place by the brackets 51. FIG. 6A is a view of the right side 30 of the assembly and shows that the gaming leg mechanism 58 is still locked and recessed within the assembly and has not rotated on its metal tubing 57 to extend down. FIG. 6B is an alternate view of FIG. 6A showing a perspective view of the rear 40 of the assembly, as it would appear if standing as an independent table.

Figures 7A, 7B, 7C:
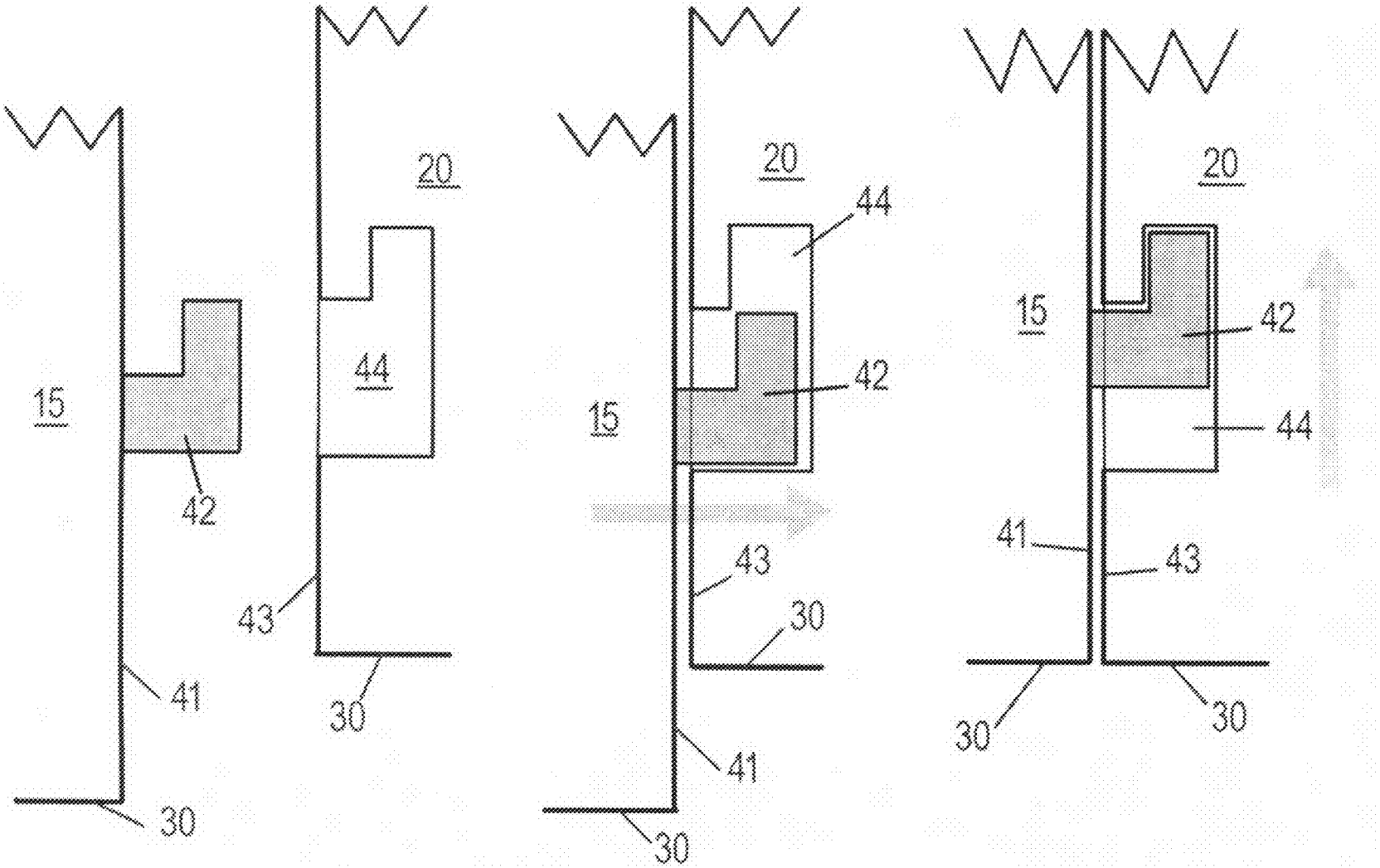
FIG. 7A is an aerial and sectional view showing the protruding and receiving mechanisms found in FIG. 1 that will most likely be used to connect the two assemblies. More specifically in regards to FIG. 1, the protruding mechanism 42 is a sectional view of the left corner of 41 on assembly 15, and the receiving mechanism 44 or 32 is a sectional view of the right corner of 43' or the bottom corner of 31 of assembly 20 respectively.
FIG. 7B is the same sectional view and assemblies shown in FIG. 7A, and shows the protruding mechanism being fully and completely enveloped in the receiving mechanism as a result of the protruding assembly 15 being pushed together with the receiving assembly 20.
FIG. 7C is the same sectional view and assemblies shown in FIGS. 7A and 7B, and shows the tables locked and connected as the result of the protruding assembly 15 being slide upward into the remaining portion of the receiving mechanism on assembly 20.

FIGS. 7A, 7B, and 7C together are a magnified and sectional aerial view of invention 10, demonstrating how the male assembly 15 would most likely lock into place with the female assembly 20 to create one of the two tables that will be depicted in FIG. 8 and FIG. 9. Specifically, FIGS. 7A-C depict how the male assembly's 15 protruding connector piece 42 will be inserted and locked within the female connector piece 44 of assembly 20. It must be noted that FIGS. 7A-C are labeled to depict the assemblies 15 and 20 connecting end-to-end 41-to-43 as shown in FIG. 8, but the identical motion would be used to connect the assemblies perpendicular to one another to form an L-shaped table as shown in FIG. 9. Also, despite the fact that FIGS. 1-3 show there being two connecting mechanisms on each side, there may ultimately be three or free connecting mechanisms on the final product depending on the materials used in the construction of the invention 10. The first step to connect the tables is to line up the male connector piece 42 with the opening of the female connector piece 44 as shown in FIG. 7A. The male connector piece 42 will most likely be made of some sort of metal or rigid plastic. The right side 30 of assembly 15 must be slightly lower than the left side 30 of assembly 20, in order for the invention 10 to line up in a straight line when the assemblies 15 and 20 are locked into place as in FIG. 7C. The distance of this misalignment will likely not be more than a couple inches. The next step in the process is to push the two assemblies 15 and 20 together, so that the male connector piece 42 is completely within the female connector piece 44 as shown in FIG. 7B. FIG. 7C shows the two assemblies 15 and 20 locked together. The male connector piece 43 has now been slide upward into the notched out hole within the female connector piece 44. With one of these connecting mechanisms 42 and 44 on opposite ends of each side of the assemblies 15 and 20, the invention should be solid and should not be able to be pulled apart. FIG. 7A-C is included in this writing to show the examiner one possible way the invention 10 could be connected, however there are many different alternatives that may ultimately be used to connect the assemblies 15 and 20. FIG. 7A-C should not be understood to be the only or best way the assemblies 15 and 20 can be connected the inventors reserve the right to change the locking mechanism in the final product, as long as the final locking mechanism operates in roughly the same manner.

Figure 8A:
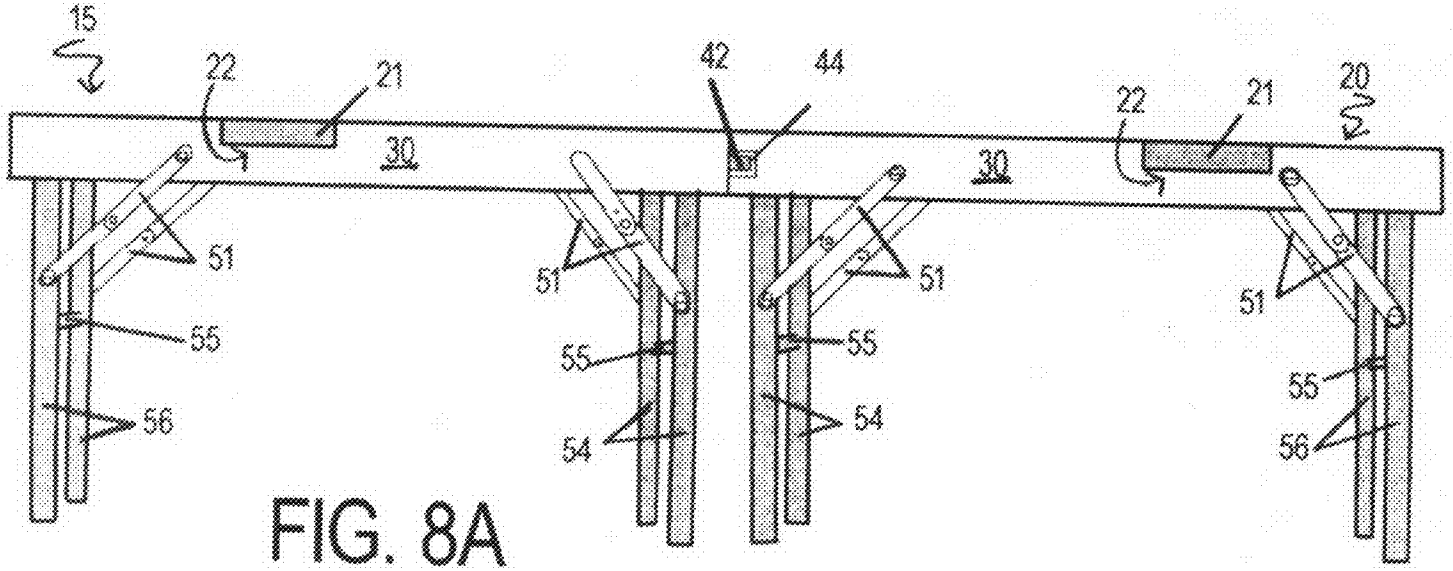
FIG. 8A is a perspective side view of the assemblies locked together end to end to create a beer pong or dinning table.

FIG. 8A is a perspective side view 30 of the invention 10 connected end-to-end 41-to-43 as referenced in FIG. 1, thus creating an elongated dinning table, or alternatively, a beer pong table. The approximate length of the elongated table is eighty-eight inches, with an approximate width of twenty-four inches. As shown in FIG. 8A, all four of the invention's 10 table leg mechanisms 54 and 56 are extended and locked into position by their respective brackets 51. The male assembly's 15 protruding connector pieces 42 are completely engulfed and locked into the female assembly's 20 receiving connector pieces 44. FIG. 8A illustrates what the invention 10 would look like if the cover caps 21 were inserted flush within the invention's through apertures 22. However, as mentioned earlier, there will mostly likely be other attachments that will be manufactured to fit within the invention's 10 two through apertures 22. The cover caps 21 shouldn't be understood to be the only possible attachments that could be inserted into the invention's through apertures 21.

Figure 8B:
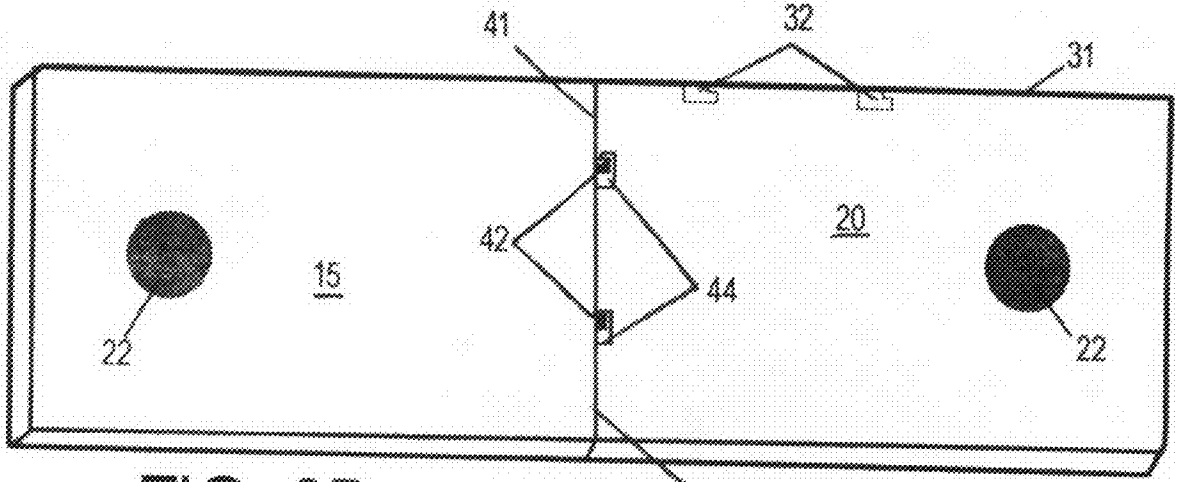
FIG. 8B is an aerial view of the assemblies shown in FIG. 8A.

FIG. 8B is an alternate and aerial view of FIG. 8A. FIG. 8B shows more clearly than FIG. 8A, how the two assemblies 15 and 20 are connected end-to-end 41-to-43 and locked by their respective connecting pieces 42 and 44. The cover caps 21 depicted in FIG. 8A have been removed in FIG. 8B leaving the invention's through apertures 22 exposed. The female connector pieces 32 on the topside 31 of the female assembly 20 are not in use and are located within the middle of the topside 31 of assembly 20. While the female connector pieces 32 appear to be located on the top playing/dinning surface of assembly 20 in FIG. 8B, they are not positioned on the surface, but on the side 32 of the table and are only shown in FIG. 8B to assist the examiner.

Figure 9A:
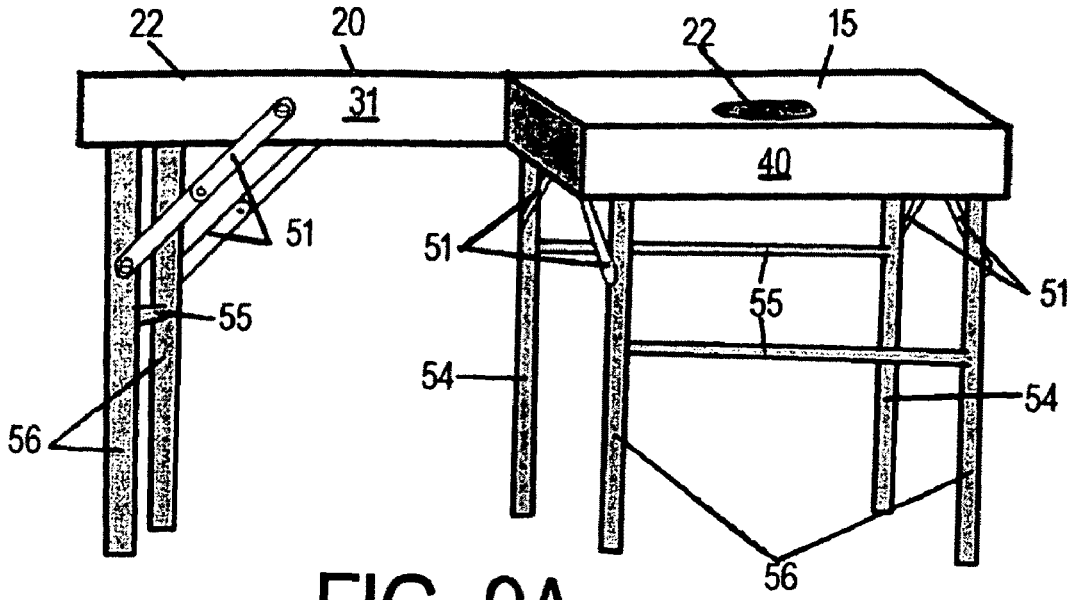
FIG. 9A is a perspective view of the assemblies locked together perpendicularly to create the L-shaped buffet or serving table.

FIG. 9A is a perspective view of the side 31 of assembly 20 and the rear 40 of assembly 15, as they would appear if connected perpendicular to each other, forming an L-shaped serving table. Each assembly's through apertures 22 would be located on opposite sides of the table from one another. All four of the invention's table leg mechanisms 56 and 54, are completely extended and locked into place by eight brackets 51. Not shown in FIG. 9A, are the extended front leg mechanism 54 and its support bar 55 of one of the assemblies 20. This leg mechanism 54 was omitted intentionally, so as not to make FIG. 9A too cluttered and confusing for the examiner. However, it should be understood that this leg mechanism 54 and its support bar 55 would be fully extended and locked into place by two brackets 51.

Figure 9B:
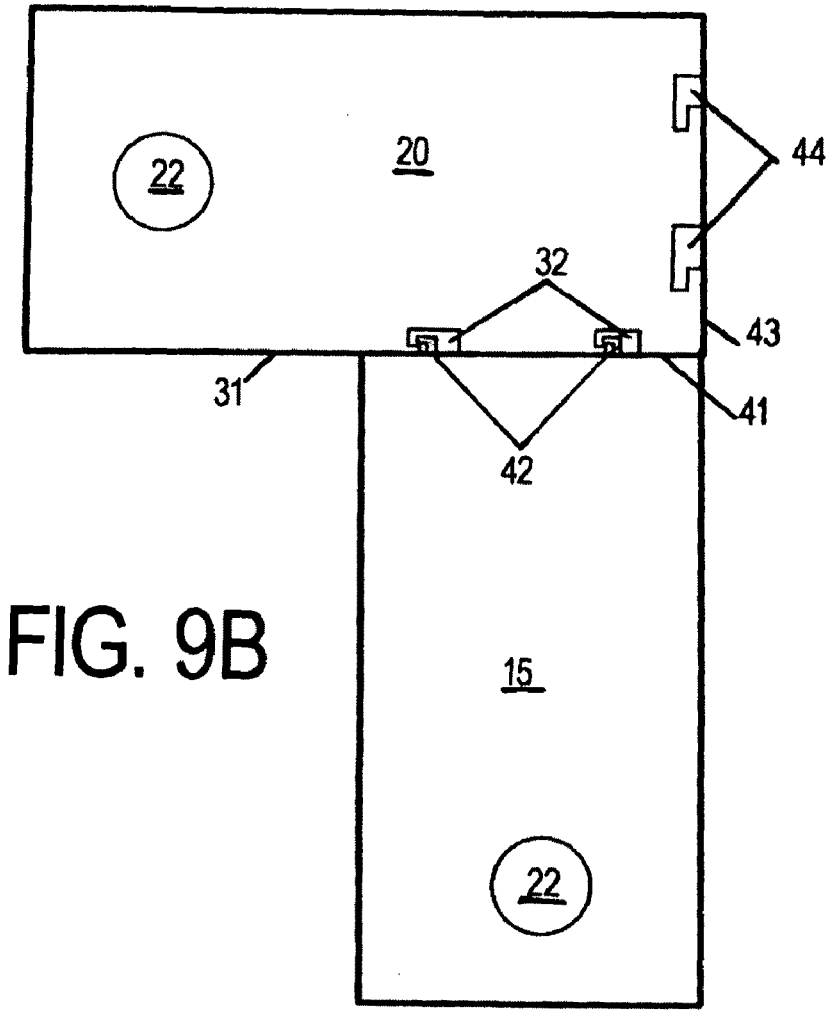
FIG. 9B is an aerial view of the figures shown in FIG. 9A.

FIG. 9B is an alternate, aerial view of FIG. 9A and shows more clearly how the two assemblies 15 and 20 have been connected and also the positioning of the two through apertures 22 on the surface of the table. While the through apertures 22 are not covered by the cover caps 21 shown in FIG. 1 and FIG. 8A, or any other attachment, it should not be understood that the apertures 22 could not be fitted with the cover caps 21 or any other attachment that may be manufactured. As shown in FIG. 9B, the male connector pieces 42 situated on the front side 41 of the male assembly 15 are completely engulfed and locked into the female connector piece 32 located on the left side 31 of the female assembly 20. The female connector piece 44 not in use is situated on the front 43 of assembly 20, about one inch from the surface of the table. While it may appear that these idle connector pieces 44 are located on the surface of assembly 20, they are illustrated to ease the understanding of the examiner and should not be construed to be two indentions on the surface of the table.

Figure 10A:
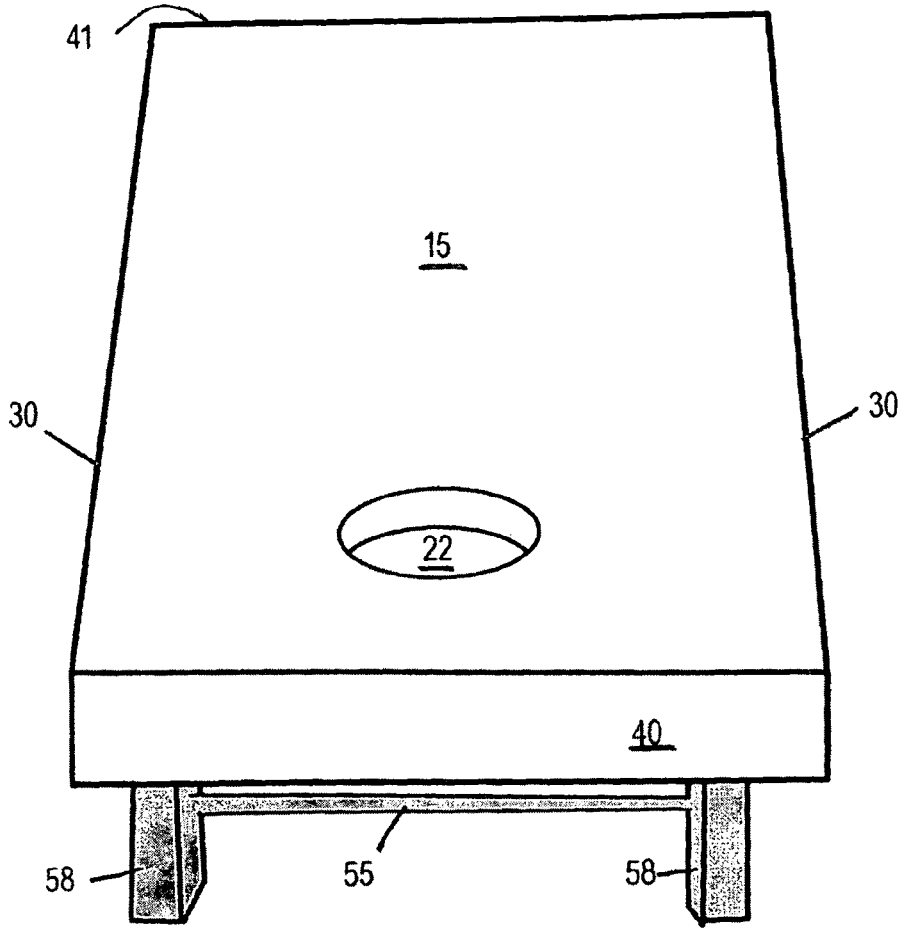
FIG. 10A is a perspective rear of one of the assemblies, as it would appear during game play.

FIG. 10A is a semi-aerial view of the male assembly 15 when serving as a cornhole game. FIG. 10A is taken from the rear 40 of the male assembly looking down the slope towards the front 43 of the assembly 15. While FIGS. 10A and 10B portray only one of the assemblies 15, it should be understood that the other assembly 20 would look and operate in the exact same way. FIG. 10A illustrates what the game leg mechanism 58 would look like after it has rotated about its metal tubing 57, as shown in FIG. 2, and been locked into place by its two brackets 51 perpendicular to the gaming assembly 15. The makeup and operation of the brackets 51 are identical to those illustrated in FIGS. 4A, 4B, and 5. Similarly, the extension and locking process of the game leg mechanism 58 are almost identical to that of the table leg mechanisms 54 and 56, as described previously in FIGS. 4A, 4B, and 5. In this view, the only leg mechanism extended and in use from the underside of the assembly 15 is the game leg mechanism 58. When the game leg mechanism 58 is in use, the front side 41 of the assembly 15 is in direct contact with the ground. The function of 58 is to lift the rear of the assemble twelve inches off the ground to allow the target assembly to sit at approximately 45 degrees.

Since the only leg mechanism extended from the underside of the assembly 15 is the game leg mechanism 58, when placed on a horizontal surface, the front side 41 of the assembly 15 is in direct contact with the ground because the game leg mechanism 58 lifts the rear of the assembly 15 approximately twelve inches off the ground and creating an inclined cornhole playing surface, with the through aperture 22 located towards the top of the incline for beanbags to be thrown at and through. The degree of the incline is approximately 45°.

Figure 10B:
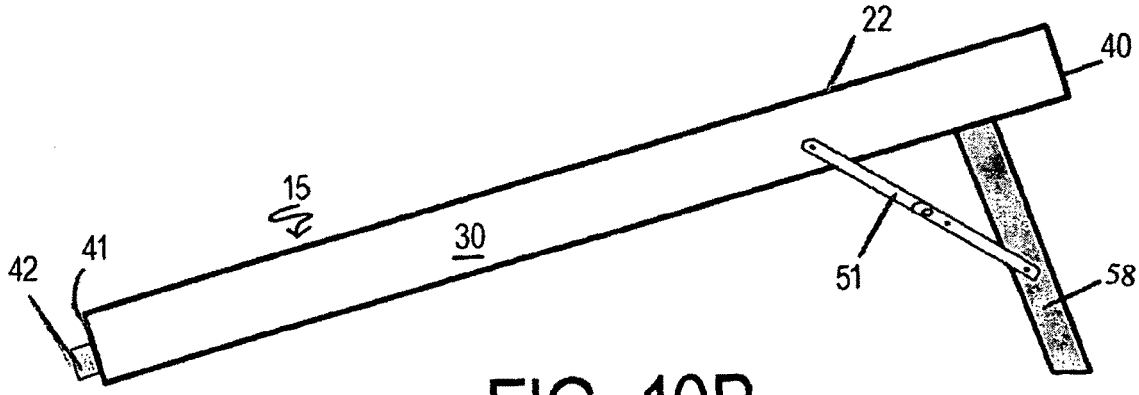
FIG. 10B is a perspective side view of one the assemblies, as it would appear during game play.

FIG. 10B is an alternate and perspective view of FIG. 10A, depicting the left side 30 of the male assembly 15, as it would appear in cornhole game mode. FIG. 10B is identical to FIG. 10A in every way and is included to better illustrate one of the brackets 51 in its full and locked position and also to show the incline and slope of the assembly 15 in cornhole game mode, which like FIG. 10A is approximately 45°.

What is claimed is:

1. Two (2) separate, substantially identical, portable, and generally rectangular recreational systems for use by one or more players, both capable of serving as tables and projectile tossing games and each consisting of a through-aperture and four sides two shorter sides opposite one another ("Short Sides") and two longer sides opposite of one another ("Long Sides") adapted to be:

(i) oriented separately in an inclined configuration at an approximately 45° angle with the ground, so as to dispose each recreational system in game-play mode ("Game Mode");

(ii) oriented separately in an elevated configuration, horizontal with the ground, disposing each recreational system as a free-standing table ("Table Mode");

(iii) arranged and coupled to one another in three (3) unique ways, while each recreational system is in Table Mode, disposing the recreational systems together in three (3) distinct tabletop formations as more fully described herein;

each of said recreational systems comprising:

a resilient, rigid, planar tabletop/target surface comprising a through-aperture, dimensioned to allow projectiles to pass entirely within and through it;

two (2) cover caps designed to fit securely within and completely cover each recreational systems' through-aperture, creating a solid planar surface;

a plurality of projectiles to be tossed by participants at each recreational system's through-aperture while the recreational systems are disposed in Game Mode;

table legs that are hingedly attached and foldably associated with an underside of both Short Sides of the recreational systems, enabling each recreational system to become a table when the table legs are in the deployed position and as a projectile tossing game when only one set of table legs are in the deployed position;

a male locking mechanism on one of the shorter sides of one of the systems, a first female locking mechanism on one of the other shorter sides of the other system, a second female locking mechanism on one of the longer sides of the same system as with the first female locking mechanism so as to couple or arrange the systems in said three unique ways.

2. The recreational system as defined in claim 1, wherein the foldably associated table legs enable the recreational systems to be selectively disposed in either:

i) a storage mode orientation, formed when all table legs are folded up to become parallel with the planar tabletop surface and stowed beneath the underside of each recreational system; or ii) an inclined Game Mode orientation, formed when one set of table legs of each recreational system are deployed perpendicular to the planar tabletop surface of said recreational system, thereby inclining the planar tabletop surface of the recreational system at an approximately 45° angle with the ground; or iii) an elevated, horizontal Table Mode orientation, formed when the table legs of each recreational system are deployed perpendicular to each recreational system, creating an approximately 90° angle with the ground and elevating the planar tabletop surface of each recreational system horizontal to and above the ground.

3. The recreational system as defined in claim 1, wherein the recreational systems can be arranged in three (3) distinct formations while in said Table Mode, as follows:

i) an L-shaped bar/serving table, formed when said male locking mechanism is coupled with the second female locking mechanism;

ii) a long dining/beer pong table formed when said male locking mechanism is coupled to the first female locking mechanism; and iii) a table formed when the recreational systems are placed longer side-by-longer side.

* * * * *